US005591507A

United States Patent [19]

Jones

[11] Patent Number: 5,591,507

[45] Date of Patent: Jan. 7, 1997

[54] ABSORBANT CLOTH WITH AGITATING FEATURE

[76] Inventor: Samuel S. Jones, 745 Redbud La., Greenwood, Ind. 46142

[21] Appl. No.: 417,134

[22] Filed: Apr. 4, 1995

[51] Int. Cl.[6] ..... B32B 3/02; A47L 13/12; A47K 7/02

[52] U.S. Cl. ..... 428/88; 428/89; 428/92; 15/114; 15/118; 15/208; 15/209.1; 15/229.11; 15/244.3

[58] Field of Search ..... 428/88, 89, 92; 15/114, 118, 208, 209.1, 229.11, 244.3

[56] References Cited

U.S. PATENT DOCUMENTS

| | | | |
|---|---|---|---|
| 3,038,187 | 6/1962 | Nathanson | 15/229.11 |
| 3,181,193 | 5/1965 | Nobles et al. | 15/114 |
| 3,638,270 | 2/1972 | Schlegel, Jr. et al. | 15/114 |
| 4,187,575 | 2/1980 | Collins | 15/222 |
| 5,336,543 | 8/1994 | Pyle | 428/89 |
| 5,361,445 | 11/1994 | Giallourakis | 15/118 |
| 5,408,718 | 4/1995 | Sadovsky | 15/118 |

FOREIGN PATENT DOCUMENTS

| | | | |
|---|---|---|---|
| 736642 | 6/1966 | Canada | 15/114 |
| 0514191 | 11/1992 | European Pat. Off. | 428/89 |
| 1126254 | 7/1956 | France | 428/88 |
| 2229188 | 1/1974 | Germany | 15/114 |
| 6-133893 | 5/1994 | Japan | 15/208 |
| 2625 | of 1911 | United Kingdom | 15/118 |
| 278945 | 10/1927 | United Kingdom | 15/229.11 |
| 2192327 | 1/1988 | United Kingdom | 15/208 |

*Primary Examiner*—Terrel Morris
*Attorney, Agent, or Firm*—Woodard, Emhardt, Naughton, Moriarty & McNett

[57] ABSTRACT

An absorbant cloth having an agitating feature. The cloth is formed from a base material which exhibits a high degree of absorbancy. In order to achieve this high degree of absorbancy, the base material preferably exhibits a very large surface area, such as a synthetic lamb's wool. The cloth additionally has one or more areas of a rough, bristled material which is efficient at transmitting mechanical forces from movement of the user's hand to the stain. The bristled material is preferably a synthetic fabric, such as that commonly used for indoor/outdoor carpeting. In a preferred embodiment, the absorbant material and the bristled material are formed in alternating bands.

13 Claims, 1 Drawing Sheet

ABSORBANT CLOTH WITH AGITATING FEATURE

TECHNICAL FIELD OF THE INVENTION

The present invention generally relates to cleaning devices and, more particularly, to an absorbant cloth with an agitating feature.

BACKGROUND OF THE INVENTION

Most non-professional cleaning is performed by hand, using a cleaning agent (such as a shampoo or a solvent) and some sort of hand held apparatus for applying, working and lifting the cleaning agent. For example, floors, walls, vinyl wallcoverings, upholstered furniture, shower walls and tile, car interiors, etc. are all typically cleaned by hand, as is spot cleaning of carpet stains. Even in professional cleaning applications, hand cleaning methods are used to supplement machine cleaning methods. For example, a carpeted room may be cleaned by any number of professional cleaning devices designed to clean large areas of carpet in minimal time. But even with the use of such cleaning devices, it is usually necessary to clean the awkward areas, such as around the carpet edges or on stairs, by hand.

When cleaning surfaces by hand, it is necessary to apply the cleaning agent to the hand held cleaning apparatus, and to then use the hand held apparatus to apply the cleaning agent to he surface to be cleaned. The hand held apparatus is then used to work the cleaning agent into the surface in order to loosen the dirt or stain therefrom, such as by agitating the hand held apparatus on the surface in the area to be cleaned. This mechanical force acts in conjunction with the chemical action of the cleaning agent to loosen and break the bond between the stain and the surface. Finally, the hand held apparatus is used to lift the loosened dirt as well as the excess cleaning agent from the surface, leaving the surface relatively clean.

There are basically two types of hand held apparatus known in the prior art for hand cleaning: cloths (including sponges) and brushes. Cloths have the advantage that they are absorbant. Because they are capable of absorbing and holding a relatively large quantity of liquid and liquid-born dirt, cloths are well-suited to both applying the cleaning agent to the stain and to lifting the loosened dirt and excess cleaning agent from the surface. However, because of the soft and pliable nature of such cloths, they are relatively inefficient agitating devices for use in working the cleaning agent into the stain.

Brushes, on the other hand, contain many stiff bristles which are very effective at transmitting mechanical forces produced by movement of the user's hand to the surface to be cleaned. This efficient transmission of agitating forces to the stain makes brushes ideal for loosening stains from the surface to be cleaned. However, because of the stiff and straight nature of such brush bristles, they are not very absorbant and therefore relatively inefficient for applying the cleaning agent to the surface or lifting it therefrom.

These different characteristics of cloths and brushes mean that neither of them display all of the desired characteristics of a hand held cleaning apparatus, namely absorbancy and the ability to efficiently transmit mechanical agitation forces to the stain. There is therefore a need in the prior art for a hand held cleaning apparatus which is both absorbant and which will efficiently transmit agitation forces to the stain. The present invention is directed toward meeting this need.

SUMMARY OF THE INVENTION

The present invention relates to an absorbant cloth having an agitating feature. The cloth is formed from a base material which exhibits a high degree of absorbancy. In order to achieve this high degree of absorbancy, the base material preferably exhibits a very large surface area, such as a synthetic lamb's wool. The cloth additionally has one or more areas of a rough, bristled material which is efficient at transmitting mechanical forces from movement of the user's hand to the stain. The bristled material is preferably a synthetic fabric, such as that commonly used for indoor/outdoor carpeting. In a preferred embodiment, the absorbant material and the bristled material are formed in alternating bands.

In one form of the invention, an absorbant cloth having an agitating feature is disclosed, comprising a base material of relatively absorbant material having first and second sides; and at least one band of relatively rough material coupled to the base material on at least the first side, wherein a surface of the first side comprises at least one first area of relatively absorbant material and at least one second area of relatively rough material.

In another form of the invention, an absorbant cloth having an agitating feature is disclosed, comprising a base material of relatively absorbant material having first and second sides; a first band of relatively rough material coupled to the first and second sides and substantially encircling the base material; and a second band of relatively rough material coupled to the first and second sides and spaced from the first band and substantially encircling the base material.

In another form of the invention, an absorbant cloth having an agitating feature is disclosed, comprising a first plurality of relatively absorbant material strips; and a second plurality of relatively rough material strips, wherein the first plurality of strips are coupled to he second plurality of strips in an alternating sequence.

DETAILED DESCRIPTION OF THE PREFERRED EMBODIMENTS

Figure 1:
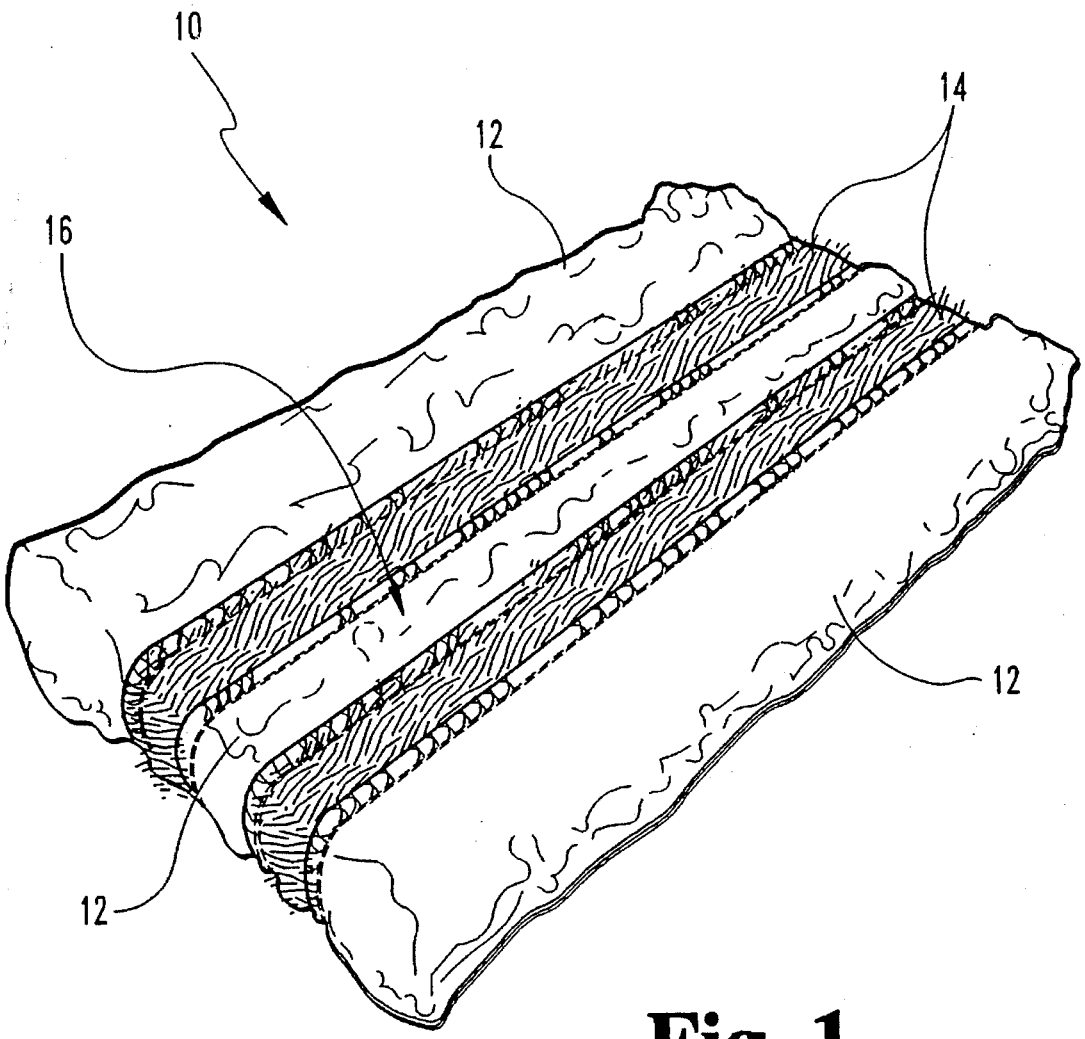
FIG. 1 is a perspective view of a first embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a first embodiment of the present invention, indicated generally at 10. The cloth 10 is formed from a base material 12 which exhibits a high degree of absorbancy. In general, absorbancy may be created by a material which has a very large surface area, a weave which is adapted to absorbing and holding liquid and/or a material formed from highly absorbant threads. In a preferred embodiment, the absorbant material 12 is formed from a synthetic lamb's wool, made from 90% polyester and 10% acrylic. It will be appreciated by those skilled in the art that many other types of absorbant material may be substituted for the synthetic lamb's wool (i.e. fleece) used in the preferred embodiment, such as genuine lamb's wool, terry cloth, or woven cotton, for example.

The absorbant nature of the material 12 makes it ideal for applying the cleaning agent thereto, as the material 12 will readily absorb a relatively large quantity of the cleaning agent and hold it within the material 12. When the cloth 10 is then applied to the surface to be cleaned, pressure may be applied to the cloth 10 by the user's hand, thereby forcing the cleaning agent from the cloth 10 and onto the surface to be cleaned. Furthermore, after agitation of the surface to be cleaned, the absorbant nature of the cloth 12 may be used to recover the loosened dirt as well as the excess cleaning solution from the surface.

The cloth 10 further includes at least one area 14 of a rough, bristled fabric attached to the material 12. In the preferred embodiment, the material 14 is a bristled olefin material which is commonly used for indoor/outdoor carpeting. A suitable material is style no. 8806, available from Shaw Industries of Dalton, Ga. It is preferred that the bristled fabric 14 be formed in elongated strips which traverse both sides of the cloth 10. The strips of bristled material 14 are attached to the absorbant material 12 by any convenient means, such as sewing the different materials to one another. In a preferred embodiment, the cloth 10 is formed from a relatively large piece of synthetic lamb's wool 12 which is folded in half and sewn around the edges thereof in order to form a cloth 10 which has the synthetic lamb's wool "fleece" on all exterior surfaces thereof. The strips of bristled material 14 may then be sewn to the exterior of the synthetic lamb's wool material 12.

The bristled material 14 is relatively efficient at transmitting agitating forces produced by the motion of the user's hand to the surface to be cleaned, thereby applying force to the stain in order to work the cleaning agent into the surface. Such mechanical action will act in conjunction with the chemical action of the cleaning agent to loosen and break the bond between the stain and the surface to be cleaned. It will be appreciated by those skilled in the art that other rough and/or bristled materials may be substituted for the indoor/outdoor carpet used for the bristled material 14 in the preferred embodiment.

It is preferred that the absorbant material 12 and rough material 14 be alternated across the face of the cloth 10 in alternating bands as shown in the preferred embodiment illustrated in FIG. 1. Such an arrangement allows for continuous application of cleaning agent from the absorbant material 12 to the surface to be cleaned during agitation of the surface by the rough material 14. Also, the placement of the absorbant material 12 in alternating proximity to the rough material 14 allows the absorbant material 12 to absorb any dirt and excess cleaning agent from the surface to be cleaned as it is agitated. It is believed that such an arrangement of the absorbant material 12 and rough material 14 offers a significant improvement over prior art devices which include a rough surface on one side and a sponge on the other side. The improvement lies in the fact that the present invention may both agitate and absorb loose dirt and excess cleaning agent at the same time, whereas the prior art device may only agitate or only absorb at any one time, it being necessary to turn the device over to switch functions.

Particularly when the cloth 10 is formed with alternating bands of the absorbant material 12 and the rough material 14, an "action pocket" 16 is created between adjacent bands of the rough material 14. In the area of the action pocket 16, cleaning agent containing loosened particles from the stain is continously being absorbed and expelled by the absorbant material 12 as the rough material 14 to either side of the action pocket 16 is agitated across the stain. Because the cleaning agent will flow more freely through the absorbant material 12 in the action pocket 16 than will the dirt particles, the action pocket 16 acts as a dirt filter, continuously absorbing cleaning agent bearing the dirt particles loosened by agitation, trapping the dirt particles therein, and expelling the filtered cleaning agent. The action pocket 16 significantly increases the synergistic effects of combining the absorbant material 12 with the rough material 14.

The cloth 10 of the present invention is ideal for hand cleaning a variety of surfaces, as it is adapted to applying a relatively large quantity of cleaning agent to the surface, will agitate the surface without scratching, and will reabsorb any excess cleaning agent. For these reasons, the cloth 10 of the present invention is ideal for spot cleaning carpets, upholstered furniture, walls, vinyl wallpaper, shower walls and tile, car interiors, carpeted stairs and carpet edges and corners which cannot be reached with professional carpet cleaning equipment. Because the cloth 10 of the present invention utilizes the rough olefin material 14 to accomplish agitation, it will not scratch delicate surfaces or ruin the pile of the carpet, as may be the case with stiff prior art brushes. The cloth 10 of the present invention may be used with any cleaning agent, such as carpet shampoo, carpet spotter (for cleaning spills) or upholstery shampoo, for example. Additionally, the cloth 10 is machine washable.

If it is desired to increase the absorbancy of the cloth 10, a sponge (not shown) may be placed into the interior of the absorbant material 12 before the main body of the cloth is sewn together. The inclusion of the sponge within the interior of the cloth 10 will dramatically increase the absorbant properties of the cloth 10 without effecting its ability to agitate.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An absorbant cloth having an agitating feature, comprising:

a base material of absorbant fleece material; and a band of rough material sewn to a surface of the base material, such that the cloth comprises a first area of absorbant material and a second area of rough material.

2. The absorbant cloth of claim 1, further comprising;

a plurality of spaced apart bands of rough material sewn to a surface of the base material such that the cloth comprises adjoining, alternating areas of absorbent material and rough material.

3. The absorbant cloth of claim 1, wherein said band substantially encircles the base material.

4. The absorbant cloth of claim 2, wherein the plurality of bands substantially encircle the base material.

5. The absorbant cloth of claim 1, wherein the base material comprises fleece comprising 90% polyester and 10% acrylic.

6. The absorbant cloth of claim 1, wherein the band comprises indoor/outdoor carpeting material having a weather resistant pile.

7. The absorbant cloth of claim 5, wherein the base material is formed by folding a quantity of fleece substantially in half and sewing the adjoining edges thereof together in order to form an interior pocket.

8. The absorbant cloth of claim 7, further comprising a sponge retained within the interior pocket.

9. An absorbant cloth having an agitating feature, comprising:

a base material of absorbant fleece material; and a plurality of spaced apart bands of rough material sewn to a surface of the base material such that the cloth comprises adjoining, alternating areas of absorbent material and rough material.

10. The absorbant cloth of claim 9, wherein the base material comprises fleece comprising 90% polyester and 10% acrylic.

11. The absorbant cloth of claim 9, wherein the plurality of bands comprise indoor/outdoor carpeting material having a weather resistant pile.

12. The absorbant cloth of claim 10, wherein the base material is formed by folding a quantity of fleece substantially in half and sewing the adjoining edges thereof together in order to form an interior pocket.

13. The absorbant cloth of claim 12, further comprising a sponge retained within the interior pocket.

* * * * *